US005430003A

United States Patent [19]

Hutt et al.

[11] Patent Number: 5,430,003

[45] Date of Patent: Jul. 4, 1995

[54] THERMAL TRANSFER PRINTING RECEIVER SHEET AND METHOD

[75] Inventors: Kenneth W. Hutt, Nr Manningtree; Ian R. Stephenson, St Andrews, both of England

[73] Assignee: Imperial Chemical Industries PLC, London, England

[21] Appl. No.: 190,200

[22] PCT Filed: Jun. 15, 1993

[86] PCT No.: PCT/GB93/01267

§ 371 Date: Jun. 6, 1994

§ 102(e) Date: Jun. 6, 1994

[87] PCT Pub. No.: WO93/25392

PCT Pub. Date: Dec. 23, 1993

[51] Int. Cl.[6] ..... B41M 5/035; B41M 5/38

[52] U.S. Cl. ..... 503/227; 428/195; 428/328; 428/523; 428/913; 428/914; 430/200; 430/945

[58] Field of Search ..... 8/471; 428/195, 523, 428/913, 914, 328; 430/200, 945; 503/227

[56] References Cited

FOREIGN PATENT DOCUMENTS

| | | | |
|---|---|---|---|
| 365222 | 4/1990 | European Pat. Off. | 503/227 |
| 409598 | 1/1991 | European Pat. Off. | 503/227 |
| 454083 | 10/1991 | European Pat. Off. | 503/227 |
| 2217866 | 11/1989 | United Kingdom | 503/227 |

*Primary Examiner*—B. Hamilton Hess
*Attorney, Agent, or Firm*—Cushman Darby & Cushman

[57] ABSTRACT

A method of light induced thermal transfer printing which comprises printing directly onto a substantially apolar material for example a polyolefin without the need for a release agent in the dye-receptive surface and imaged receiver sheets comprising a dye receptive surface containing a substantially apolar material.

6 Claims, 3 Drawing Sheets

THERMAL TRANSFER PRINTING RECEIVER SHEET AND METHOD

This invention relates to a thermal transfer printing method and to an imaged receiver sheet produced by the method.

Thermal transfer printing is a printing process in which a dye is caused, by thermal stimuli, to transfer from a dyesheet to a receiver sheet. In such processes, the dyesheet and receiver sheet are placed in intimate contact, the thermal stimuli are applied to the dyesheet and the dyesheet and receiver sheet are then separated. By applying the thermal stimuli to pre-determined areas in the dye-sheet, the dye is selectively transferred to the receiver to form the desired image.

The thermal stimuli were originally provided by means of mechanical print heads incorporating small electrical heaters. More recently, however, the thermal stimuli have been provided by heat inducing light, for example a laser.

Receiver sheets conventionally comprise a substrate with a dye-receiving polar surface on one side, into which a dye is thermally transferable and retainable. Where the substrate is itself polar and capable of receiving a dye, the dye may be transferred directly to a surface of the substrate. However receiver sheets typically comprise a substrate supporting a receiver layer specifically tailored to receive the dye. Receiver sheets may also comprise a backcoat to impart desirable characteristics including improved handling properties and to provide for improved ease of lamination. It is known to use polar polymers, for example, polyester and polyvinyl alcohol/polyvinylchloride copolymer, in the receiver layer as such polymers provide for good dye compatibility.

By "polar polymers" we mean a polymer comprised of monomeric units which have a significant dipole moment.

Dye sheets conventionally comprise a substrate having on one side thereof, a dye layer comprising a thermally transferable dye dissolved and/or dispersed in a polymeric binder, which again is a polar polymer. Where heat inducing light is to be employed, it is necessary to employ a light-absorbing material which may be present in the dye coat or may be present in a separate layer preferably located between the dye coat and the substrate in order to allow absorption of the inducing light.

However, as the dyesheet and receiver sheet are in intimate contact during the printing process and high temperatures are employed, problems with the polar substrate or receiver layer ant the dyesheet bonding together at least temporarily, have been encountered. A consequence of this bonding is that further undesirable transfer of dye from the dyesheet to the receiver sheet may occur in addition to the desired dye transfer causing loss of tone control and, in extreme cases where other components of the dye coat transfer, production of a half tone rather than a continuous tone image.

This problem has been addressed by employing a further component in the receiver layer to act as a release agent to facilitate the separation of the polar surface of the receiver sheet and the dye sheet at the required time, thus reducing the risk of unwanted dye transfer. Examples of release agents include silicone polymers for example siloxanes.

The provision of a receiver layer on the substrate allows a release agent to be incorporated in the dye-receptive surface but may lead to an increase in the cost of production of receiver sheets. Further, the presence of a release agent as an extra component in a receiver layer may also complicate the formulation and coating of the receiver layer onto the substrate.

An increasing use of thermal transfer printing is in the preparation of prints from images generated by a colour video camera. Clearly , it is important that the quality of such prints be equal to that of prints provided by conventional silver halide photographic methods. In particular, a reflective optical density of at least 1.6 is required for commercial acceptance. In addition, it is advantageous if a thermal transfer print has the same feel as a photographic print.

It is well known that photographic prints are produced on paper having a surface coating of a polyolefin. Such paper is relatively cheap, is readily available and would, of course give the same feel as photographic prints. Hence, there would be considerable advantages in using it for the preparation of thermal transfer prints. In particular, as polyolefins are apolar polymers( ie polymers comprised of monomeric unit which do not have a significant dipole moment) any tendency to bond to the polar material of the dye sheet is likely to be less.

GB Patent Specification No 2 217 866 does, in fact, disclose the use of such paper for thermal transfer prints using a heated print head as the source of the thermal stimuli. However, there is no disclosure of the optical density attained and tests have shown that the maximum O.D. achievable is only circa 50% of the commercially acceptable value. Moreover the prints have a tendency to fade with time. Hence the use of such paper with "conventional" thermal transfer printing is not viable.

As mentioned previously, lasers are now being used as the source for the thermal stimuli and it is known that thermal printing using a laser produces an increase in O.D. of only circa 30% when used with a conventional receiver sheet. Hence, it would be expected that the best O.D. obtainable with a laser and an apolar receiver sheet would be of the order of 1.4, still substantially below the commercially viable value.

Surprisingly, we have now found that prints with an O.D. in excess of 1.6 are obtainable using a apolar receiver sheet when the thermal stimuli are produced by heat inducing light.

According to a one aspect of the invention there is provided a method of light-induced thermal transfer printing which comprises providing a receiver sheet having a dye-receptive surface and a dye sheet having a light absorbing material for converting the inducing light into thermal energy and a dye coat comprising a binder and a dye, arranging the dyesheet on the receiver sheet such that dye coat and the said surface are adjacent, preferably in intimate contact, applying inducing light to the dyesheet which is absorbable by the light absorbing material to produce thermal stimuli in predetermined areas of the dye sheet thereby to cause dye to transfer from the dye coat to the surface and separating the dyesheet and the receiver sheet wherein the said surface contains, as a dye-receptive medium, a substantially apolar organic polymeric material.

By "dye-receptive surface" we mean the volume of the receiver sheet defined by at least part of the surface thereof and the depth of the sheet at that surface to which a dye may be transferred in a thermal transfer printing process.

Suitably, the substantially apolar material comprises an organic polymer having monomeric units a significant proportion of which do not comprise halogens and/or functional moieties comprising heteroatoms.

The invention further provides an imaged receiver sheet comprising a substrate optionally supporting a receiver layer which substrate (or, if present, receiver layer) has a dye-receptive surface which contains, as a dye-receptive medium, a substantially apolar polymeric organic material containing a thermally transferable dye defining an image wherein the said dye is transferred to said dye-receptive surface by means of a light induced thermal transfer printing process.

A method and imaged receiver sheet according to the invention is advantageous as it enables a dye to be retained in the substantially apolar material of the receiver sheet without the need for the presence of a polar material to provide the appropriate dye compatibility and a dye image of acceptable quality may be secured. Further, the substantially apolar polymeric material in the receiver sheet has less of a tendency to stick to the dye sheet with which it is in contact during printing hence there is no need for a release agent as may be required with conventional receiver sheets to facilitate the release of the two sheets. A further benefit of the invention, as a consequence of not requiring a release agent, is that it is not necessary to provide a separate receiver layer (in which the release agent is typically located) on the substrate. An additional important advantage is that the feel of the final print will be substantially the same as a photographic print.

However, we do not exclude the case where a receiver layer is present on the substrate of a receiver sheet of the invention provided that the said layer contains, as a dye-receptive medium, a substantially apolar polymeric organic material. Thus, the presence of a receiver layer is optional rather than being necessary to accommodate a release agent. Furthermore, the nature of the receiver layer need not be constrained by the requirement that it be compatible with a release agent.

The substantially apolar material contained in the dye-receptive surface suitably comprises a polyolefin, a mixture and/or a block or random Copolymer of polyolefins. Preferred polyolefins include polypropylene and polyethylene, isotactic polypropylene being particularly preferred. A blend of polyolefins may be employed, and the relative amounts of the components of the blend may be selected to provide desirable porosity and surface gloss characteristics.

The substantially apolar material may be solid, porous or voided as desired.

Suitably the substantially apolar polymeric organic material is present in the dye-receptive surface in an amount by weight greater than any other organic component in the surface, preferably in an amount of at least 50%, especially at least 80% and desirably substantially 100% by weight of organic components in the said surface.

The dye-receptive surface preferably also comprises an inorganic filler to impart opacity which is especially desirable if the receiver sheet comprises a substrate without any receiving layer and to provide improved wear characteristics and optical density. Suitable fillers include alumina, silica and particularly titanium dioxide.

A particularly preferred receiver sheet according to the invention comprises an isotactic polypropylene substrate having a filler comprising titanium dioxide.

The inorganic filler may be present in an amount of 0.5 to 50% and preferably 1 to 20% by weight of the dye-receptive surface.

The dye-receptive surface may comprise other organic materials, as a minor proportion of the total organic materials in the dye-receptive surface, in addition to the substantially apolar material in order to impart desired characteristics to the surface. Suitable organic materials include polymers for example polvinyl chloride, polyacrylonitrile, polystyrenes and polyesters, and also include the monomeric compounds of suitable polymers including acrylonitrilebutylstyrene (ABS). Suitably the apolar material is present in the dye receptive surface in an amount of at least 50% and preferably at least 80% by weight of the total organic components in the said surface.

Where the receiver sheet comprises a substrate having a dye-receptive surface without a separate receiver layer, the substrate is desirably adapted by the provision of a smooth surface texture.

However, the substrate may have a receiver layer on one side of the substrate, which layer comprises a dye-receptive surface comprising a substantially apolar polymeric organic material into which thermally transferable dyes can readily pass in a TTP process.

It is not necessary for the receiver layer to contain a material which acts as a release agent, preferably the receiver layer is substantially free of a release agent.

Where the receiver sheet comprises a substrate and a receiver layer having a dye-receptive surface, substrates known in the art my be employed in the present invention including cellulose fibre paper, synthetic paper for example TYVEK synthetic paper, thermoplastic films for example polyethylene terephthalate (desirably biaxially orientated), filled and/or voided thermoplastic films for example pearl film, and laminates of two or more substrate materials.

It is essential that the dye-receptive surface of the receiver layer comprises a substantially apolar organic polymeric material. However, that part of the receiver layer which does not function as the dye-receptive surface may comprise a conventional receiver layer material for example polar polymers as described herein.

The substrate may also have a back coat on the opposite side to the dye-receiving surface, if desired, to impart desirable properties for example, to improve handling characteristics and to aid adhesion of a protective cover sheet to the receiver sheet.

Suitably, the back coat, if present, comprises a cross-linked polymer binder and is provided to impart desirable properties to the receiver sheet for example improved handling characteristics and reduced tendency to retransfer the dye at low temperatures. If desired, the back coat may have a textured surface which may be imparted by a filler material or by the polymer per se.

Suitably a receiver sheet made according to the present invention may be laminated with a cover sheet on both sides to provide protection for the image on the sheet so that the receiver sheet is suitable for use as for example as a security or identity badge. The cover sheet may be the same or different on the different sides of the sheet and is preferably transparent on at least one side of the sheet. The cover sheet suitably comprises a thermoplastic film, for example polyvinyl chloride, polyethylene terephthalate and polycarbonate compositions. When used in such a way, the receiver sheet may be in the form of a film of apolar polymeric material.

The inducing light is desirably a laser, for example Nd:YAG, Argon ion and Ti:sapphire and preferably a laser diode.

For lasers operating in the near infra-red, there are a number of organic materials known to absorb at the laser wavelengths. Examples of such materials include the substituted phthalocyanines described in EP-B-157,568, which can readily be selected to match laser diode radiation at 750–900 nm, for example and carbon black pigment which has a broad absorption spectrum and is thus useful for a wide range of visible light and infra red emitting lasers.

Also of importance is the provision or sufficient absorber for the system used. It is desirable to use sufficient to absorb an least 50% of the incident inducing light. We prefer to use sufficient to absorb at least of the inducing light, to obtain an optical density of 1 in transmission, although higher proportions may be used if desired.

A variety of materials can be used for the dyesheet substrate, including transparent polymer films of polyesters, polyamides, polyimides, polycarbonates, polysulphones, polypropylene and cellophane, for example. Biaxially orientated polyester film is the most preferred, in view of its mechanical strength, dimensional stability and heat resistance. The thickness of the substrate is suitably 1–50 μm, and preferably 2–30 μm.

Any dye capable of being thermally transferred may be selected as required. Dyes known to thermally transfer, come from a variety of dye classes, eg from such nonionic dyes as azo dyes, anthraquinone dyes, azomethine dyes, methine dyes, indoaniline dyes, naphthoquinone dyes, quinophthalone dyes and nitro dyes. The dyecoat binder can be selected from such known polymers as polycarbonate, polyvinylbutyral, and cellulose polymers, such as methyl cellulose, ethyl cellulose and ethyl hydroyethyl cellulose, for example, and mixtures of these.

The dyecoat may also include dispersing agents, antistatic agents, antifoaming agents, and oxidation inhibitors, and can be coated onto the absorber layer as described for the formation of the latter. The thickness of the dyecoat is suitably 0.1–5 μm, preferably 0.5–3 μm.

The dyesheet may be elongated in the form of a ribbon and housed in a cassette for convenience, enabling it to be wound on to expose fresh areas of the dyecoat after each print has been made.

Dyesheets designed for producing multicolour prints have a plurality of panels of different uniform colours, usually three: yellow, magenta and cyan, although the provision of a fourth panel containing a black dye, has also previously been suggested. When supported on a substrate elongated in the form of a ribbon, these different panels are suitably in the form of transverse panels, each the size of the desired print, and arranged in a repeated sequence of the colours employed. During thermal transfer printing, panels of each colour in turn are held against a dye-receptive surface of the receiver sheet, as the two sheets are imagewise selectively heated the first colour being overprinted by each subsequent colour in turn to make up the full colour image.

In applying a coating to a substrate, either for the dye sheet or the receiver sheet, various coating methods may be employed including, for example, roll coating, gravure coating, screen coating and fountain coating. After removal of any solvent, the coating can be cured for example by heating or by irradiation with for example ultra violet light, electron beams and gamma rays.

BRIEF DESCRIPTION OF THE DRAWINGS

FIGS. 1, 2 and 6 depict reflectance obtained in accordance with the claimed invention while

Figure 1:
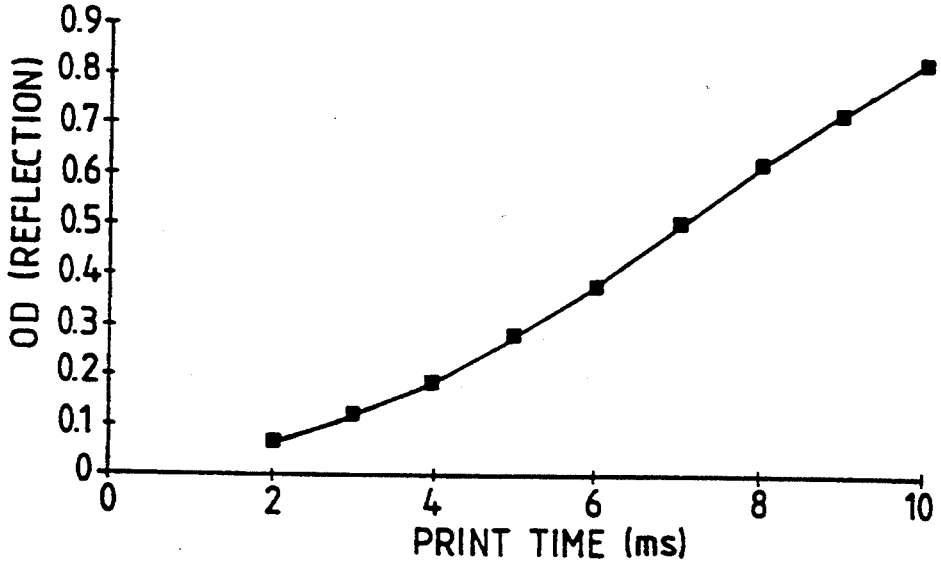

The invention will now be illustrated by way of the following non-limiting examples.

EXAMPLE 1

A receiver sheet according to the invention was prepared by coating isotactic polypropylene onto a paper substrate to a coat weight of 15 gsm.

A selection of dye sheets were prepared as follows: Dyesheets 1, 2, 3

6 μm polyester film (Toray) having a back coat and a sub-coat was coated to a dry coat thickness of approximately 1 μm by gravure printing (yellow and magenta) and 2.5 μm using a Meyer bar (cyan) with the following dye compositions (amounts are in kg unless otherwise stated) and the compositions were dried by heating in air for about 15 seconds at 100° C.:

| | Dyesheet 1 Yellow | Dyesheet 2 Magenta | Dyesheet 3 Cyan |
|---|---|---|---|
| thermal transfer dye (TTD) Y1 | 2.231 | — | — |
| TTD Y2 | 0.954 | — | — |
| TTD M1 | — | 2.505 | — |
| TTD M2 | — | 1.659 | — |
| TTD C1 | — | — | 0.865 |
| TTD C2 | — | — | 1.298 |
| Binder: PVB-BX1 | 2.547 | 2.632 | — |
| EC-T10 | 0.638 | 0.657 | 0.541 |
| EC-T200 | — | — | 1.622 |
| Infra-red absorber | 0.841 | 0.954 | 0.571 |
| Tetrahydrofuran | 50 litres | 50 litres | 50 litres |

Y1 was C1 solvent yellow 1.41; Y2 was C1 disperse yellow 126:M1 was 3-methyl-4(3-methyl-4-cyanoisothiazol-5-ylazo)-N-ethyl-N-acetoxyethyl aniline: M2 was C1 disperse red 60; C1 was 3-acetylamino-4-(3-cyano-5-phenylazothiophenyl-2-ylazo)-N,N-diethyl aniline: C2 was C1 solvent blue 63; PVB-BX1 was polyvinyl butyral BX1 from Sekisui; EC-T10 and EC-T200 were ethyl cellulose grade T10 and T200 respectively from Hercules.

The prepared dyesheets were each brought into contact with a sample of the receiver sheet according to the invention by application of 1 atmosphere pressure. An STC LT-100 laser diode operating at 807 nm was collimated and then focused using a 160 mm achromat lens. The incident laser power at the dyesheet was about 60 mW and the laser spot (full width at half maximum power) was about 30×20 μm. The laser spot was scanned by a galvanometer scanner. The dyesheet and receiver sheet were held on an arc which allowed focus to be retained throughout the scan length. The scanning equipment addressed the laser to locations 20×10 μm apart giving a good overlap of adjoining pixels. At each pixel the laser was pulsed for a specific time of between 100 and 600 μs according to the desired optical density of the pixel to provide high resolution dye pixels on the receiver sheets.

The optical density of the transmitted dye was recorded using a Sakura densitometer operating in reflection mode and the results are listed in Table 1.

EXAMPLE 2

The test carried out in Example 1 was repeated using the same dye-sheets and printing process with a receiver sheet comprising isotactic polypropylene filled with 3% by weight of the receiver sheet of titanium dioxide (futile form).

The optical density of the transmitted dye was recorded using a Sakura densitometer operating in reflection mode and the results are listed in Table 1.

EXAMPLE 3

The test carried out in Example 1 was repeated using the same dye-sheets and printing process and using a polyethylene based synthetic paper (TYVEK) as a receiver sheet.

The optical density of the transmitted dye was recorded using a Sakura densitometer operating in reflection mode and the results are listed in Table 1.

TABLE 1

| Pulse Duration | Example 1 | | | Example 2 | | | Example 3 | | |
|---|---|---|---|---|---|---|---|---|---|
| μs | Yellow | Magenta | Cyan | Yellow | Magenta | Cyan | Yellow | Magenta | Cyan |
| 50 | 0.06 | 0.04 | 0.08 | 0.15 | 0.09 | 0.09 | 0.02 | 0.1 | 0.01 |
| 100 | 0.18 | 0.18 | 0.22 | 0.22 | 0.15 | 0.13 | 0.09 | 0.13 | 0.00 |
| 150 | 0.36 | 0.36 | 0.45 | 0.33 | 0.30 | 0.28 | 0.38 | 0.57 | 0.03 |
| 200 | 0.57 | 0.57 | 0.73 | 0.52 | 0.50 | 0.50 | 0.71 | 0.85 | 0.13 |
| 250 | 0.84 | 0.84 | 1.05 | 0.70 | 0.69 | 0.97 | 0.91 | 0.93 | 0.26 |
| 300 | 1.16 | 1.15 | 1.35 | 0.90 | 0.88 | 1.24 | 0.99 | 1.01 | 0.53 |
| 350 | 1.49 | 1.48 | 1.61 | 1.07 | 1.10 | 1.44 | 1.04 | 1.12 | 0.82 |
| 400 | 1.74 | 1.71 | 1.76 | 1.29 | 1.32 | 1.63 | 1.10 | 1.22 | 1.08 |
| 450 | 1.92 | 1.84 | 1.81 | 1.51 | 1.53 | 1.83 | 1.26 | 1.23 | 1.18 |
| 500 | 2.08 | 1.93 | — | 1.71 | 1.70 | 1.88 | 1.33 | 1.36 | 1.28 |
| 550 | — | 2.0 | — | 1.79 | 1.74 | — | 1.31 | 1.32 | 1.29 |

The above results demonstrate that suitable optical density may be obtained. Further, there was no evidence of total dye transfer in the above experiments despite the absence of a release agent in the dye-receptive surface of the receiver sheet and in the dye coat of the dye sheet.

EXAMPLE 4

Figure 2:
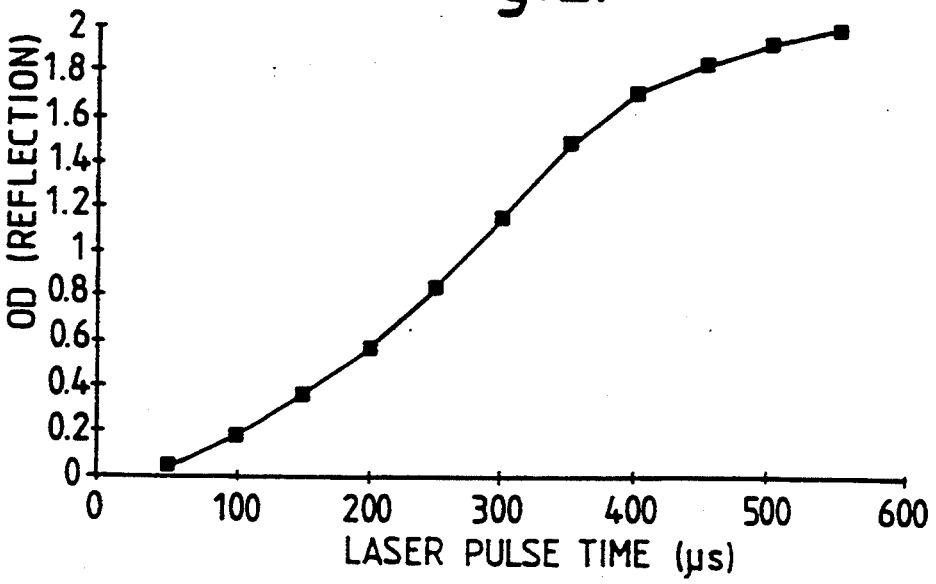
Figure 3:
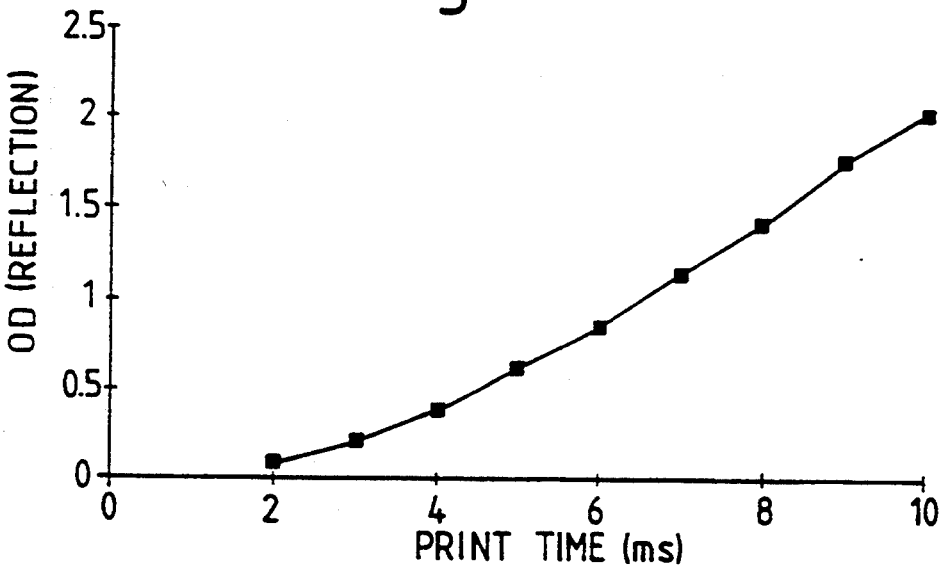
FIGS. 3–5 depict reflectance obtained with conventional receiver sheets.
Figure 4:
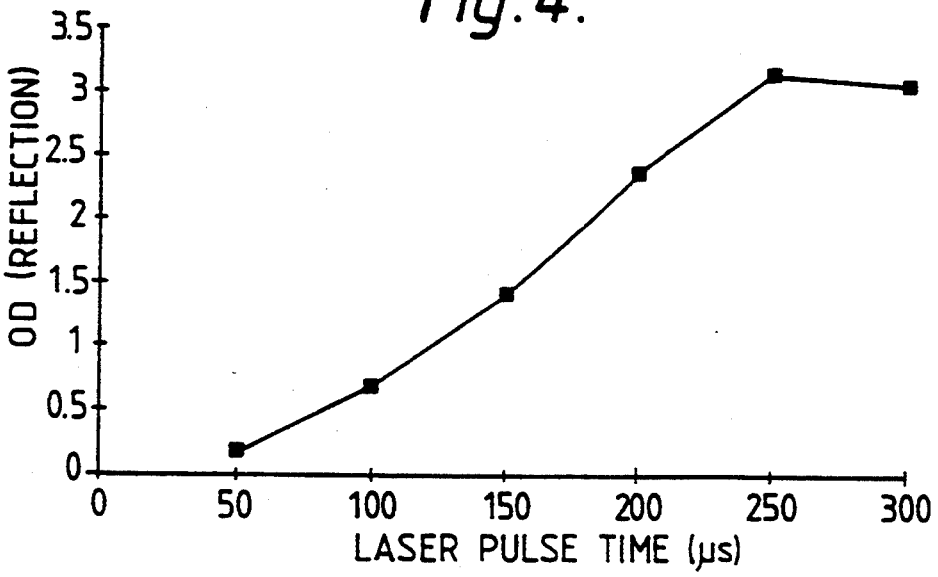

To indicate the advantages of the invention, Example 1 was repeated except that the printing of the magenta dye was carried using a progammable print head supplying heat pulses of 2 to 10 ms (ie 2000 to 10,000 μs). The results are shown in FIG. 1 and the results for magenta from Example 1 are shown in FIG. 2. An increase in maximum O.D. of from 0.8 to 2 ( ie an increase of 250%) is apparent, whereas FIGS. 3 and 4, which show the measured O.D. for magenta using a conventional receiver sheet printed by in both ways, shows an increase in maximum O.D. of from 2 to 3 ( ie an increase of only 50%).

EXAMPLE 5

Figure 5:
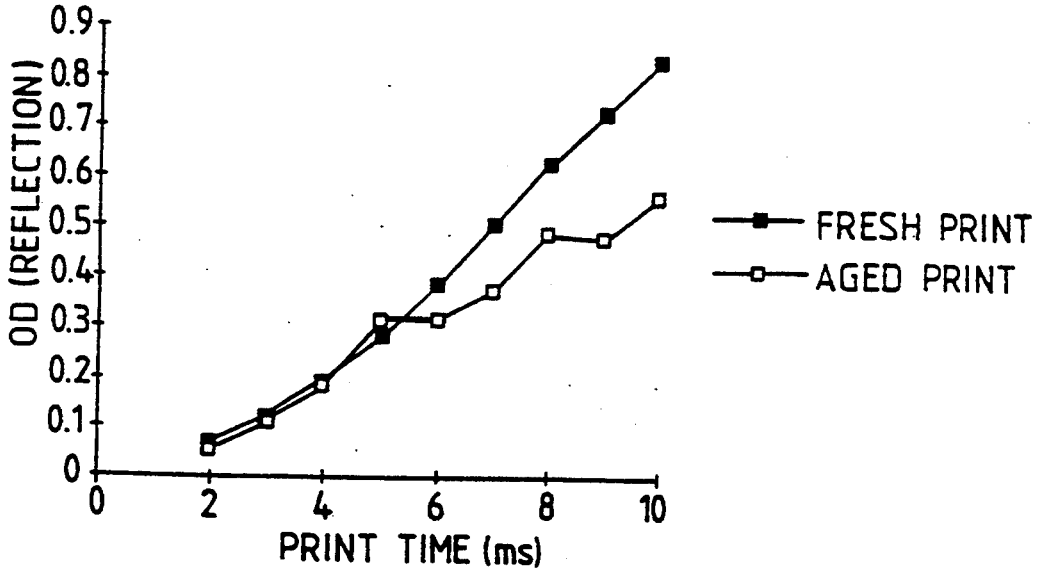
Figure 6:
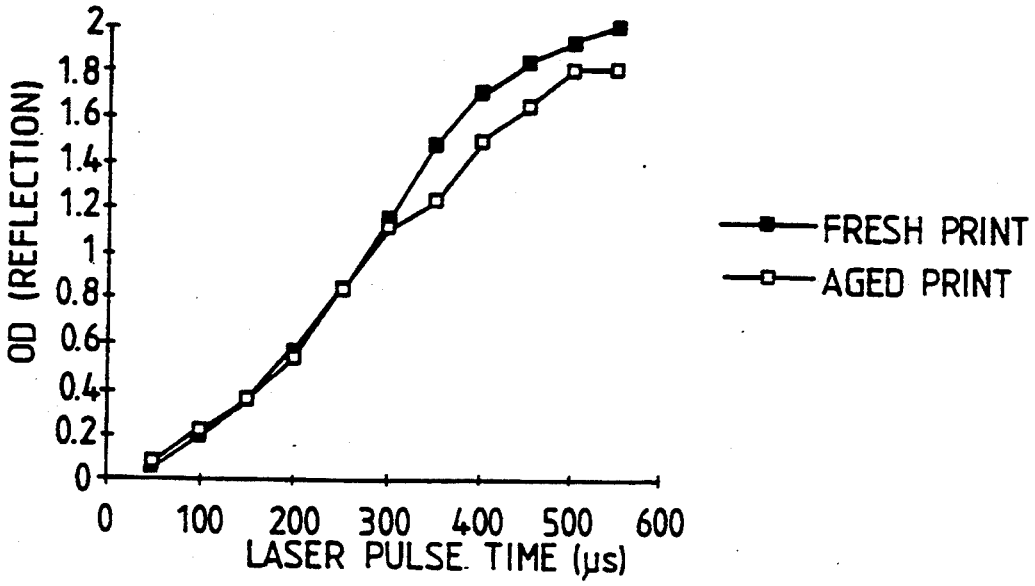

Ageing characteristics were investigated by storing the prints under ambiant conditions for circa one year and then remeasuring the O.D. FIG. 5 shows the results for prints made by the conventional print head method and FIG. 6 shows the results for prints made in accordance with the invention. In the case of conventional printing, there is an appreciable drop in O.D. at original levels as low as 0.3 whereas with printing in accordance with the invention there is no drop until an O.D. of 1.2. Moreover, conventional prints suffer a drop in maximum O.D. of 30% whereas prints according to the invention only drop by 10%.

We claim:

1. A method of light-induced thermal transfer printing which comprises providing a receiver sheet having a dye-receptive surface and a dye sheet having a light absorbing material for converting the inducing light into thermal energy and a dye coat comprising a binder and a dye, arranging the on the receiver sheet such that dye coat and the said surface are adjacent, applying inducing light to the dyesheet which is absorbable by the light absorbing material to produce thermal stimuli in pre-determined areas of the dye sheet thereby to cause dye to transfer from the dye coat to the surface and separating the dyesheet and the receiver sheet wherein the said surface contains, as a dye-receptive medium, a polyolefin material.

2. An imaged receiver sheet comprising a substrate which substrate has a dye-receptive surface which contains, as a dye-receptive medium, a polyolefin material containing a thermally transferable dye defining an image wherein the said dye is transferred to said dye-receptive surface by means of a light-induced thermal transfer printing process.

3. An imaged receiver sheet comprising a substrate supporting a receiver layer, said receiver layer having a dye-receptive surface which contains, as a dye-receptive medium, a polyolefin material containing a thermally transferable dye defining an image wherein the said dye is transferred to said dye-receptive surface by means of a light-induced thermal transfer printing process.

4. A method according to claim 1 or an imaged receiver sheet according to claim 2 or 3 in which the polyolefin is polypropylene.

5. A method according to claim 1 or an imaged receiver sheet according to claim 2 or 3 in which the dye-receptive surface further comprises an inorganic filler.

6. A method or an imaged receiver sheet according to claim 5 wherein the filler is titanium dioxide.

* * * * *